US011196222B1

(12) United States Patent
Hartman et al.

(10) Patent No.: US 11,196,222 B1
(45) Date of Patent: Dec. 7, 2021

(54) DATA CABLE CONNECTOR

(71) Applicant: Endress+Hauser USA, Automation Instrumentation Inc., Greenwood, IN (US)

(72) Inventors: Brian Hartman, Greenwood, IN (US); Gautham Karnik, Whitestown, IN (US); Matthew Krygier, Noblesville, IN (US); Tareq Al Qaisi, Plainfield, IN (US)

(73) Assignee: Endress+Hauser SE+Co. KG, Maulburg (DE)

( * ) Notice: Subject to any disclaimer, the term of this patent is extended or adjusted under 35 U.S.C. 154(b) by 0 days.

(21) Appl. No.: 17/022,279

(22) Filed: Sep. 16, 2020

(51) Int. Cl.

| | |
|---|---|
| ***H01R 31/06*** | (2006.01) |
| ***H01R 13/703*** | (2006.01) |
| ***H01B 11/00*** | (2006.01) |
| ***H01R 13/62*** | (2006.01) |
| ***H01R 11/30*** | (2006.01) |
| ***H01R 13/502*** | (2006.01) |

(52) U.S. Cl.
CPC ..... *H01R 13/7037* (2013.01); *H01B 11/00* (2013.01); *H01R 11/30* (2013.01); *H01R 13/502* (2013.01); *H01R 13/6205* (2013.01); *H01R 31/06* (2013.01); *H01R 2201/04* (2013.01)

(58) Field of Classification Search
CPC .. H01R 13/7037; H01R 11/30; H01R 13/502; H01R 13/6205; H01R 31/06; H01R 2201/04; H01B 11/00
See application file for complete search history.

(56) References Cited

U.S. PATENT DOCUMENTS

| | | | | |
|---|---|---|---|---|
| 8,362,656 | B2 * | 1/2013 | Ho | H02J 9/005 307/140 |
| 9,307,664 | B2 * | 4/2016 | Lin | H05K 7/00 |
| 2004/0220002 | A1 * | 11/2004 | Guderzo | H01R 13/7037 474/80 |
| 2007/0149013 | A1 * | 6/2007 | Eastham | H02J 13/0005 439/140 |
| 2011/0189885 | A1 * | 8/2011 | Tsai | H01R 13/701 439/488 |
| 2018/0309248 | A1 * | 10/2018 | Chen | H01R 13/5213 |

FOREIGN PATENT DOCUMENTS

EP 003393004 A1 * 10/2018

* cited by examiner

*Primary Examiner* — Tho D Ta
(74) *Attorney, Agent, or Firm* — Mark A. Logan; Endress+Hauser (USA) Holding Inc.

(57) ABSTRACT

Disclosed is a data cable connector for a field device of process automation, wherein the data cable connector has a field device part and a data cable part. The field device part includes one or more magnetically activated switches. The data cable part includes a magnet. The field device is configured to determine from the states of the magnetically activated switches whether the data cable part is connected with the field device part, and if so, in what orientation. Based on the states of the magnetically activated switches, the field device may enable and disable communication circuits within the field device including any PHY circuits and modems.

14 Claims, 5 Drawing Sheets

DATA CABLE CONNECTOR

TECHNICAL FIELD

The present disclosure relates generally a data cable connector for a field device for use in process automation systems.

BACKGROUND

Process automation field devices may be discrete devices used in a process automation system for the measurement of some physical phenomena. In a conventional field device, the field device may include electronics such as a microcontroller, memory, transducers, and analog-to-digital converters. The field device may include digital and analog outputs, for example, a 4-20 mA current output or a 1-5 V voltage output. The field device may further include one or more digital communication interfaces.

One or more of the field device's digital communication interfaces may be a service interface, that is, a digital communication interface used in the servicing of the field device. The servicing of the field device may include, for example, a service technician connecting a field service tool, i.e., a portable or hand-held computer, to the service interface, reading measured values from the field device, reading and writing one or more field device operating parameters, and updating and modifying the field device's operating software.

The servicing of the field device may be an infrequent or occasional event, and therefore the use of the service interface may be only infrequent or occasional. The field device's service interface may therefore be unconnected to any external device—and therefore unused—during typical operation of the field device. However, the field device may need to keep the service interface powered, i.e., not disabled, so that the service interface is available for the connection of the service technician's service tool.

If the field device is a battery-powered field device, an enabled yet unused service interface may unnecessarily consume electrical power. Some interfaces, such as the Highway Addressable Remote Transducer (HART), require a modem for the digital communication. Keeping the HART modem, for example, energized when it is not needed may unnecessarily consume the energy store of the field device's battery. In such battery-powered field devices, it is desirable that the service interface is switched on when needed and switched off when no longer needed.

SUMMARY

Accordingly, there remains a need for further contributions in this area of technology. According to at least one embodiment of the disclosure, disclosed is a data cable connector comprising a field device part embodied to connect with a process automation field device, the field device part including a first printed circuit board (PCB) including a magnetically activated switch disposed on a first side of the PCB and a first plurality of electrical contacts disposed on the first side of the first PCB and extending from the first PCB; a plurality of wires electrically connected with the magnetically activated switch and with the first plurality of electrical contacts, wherein the plurality of wires extend from a second side of the first PCB; and a first housing having a first recess disposed at a first end of the housing, a second recess disposed at a second end of the housing, and a back plate disposed interior to the second recess, wherein the back plate separates the second recess from the first recess, wherein the first end of the first housing is embodied to mechanically attach to a field device such that the attaching to the field device closes and seals the first recess, wherein the back plate includes a first plurality of through-holes, wherein the first PCB is disposed inside the first recess such that each of the first plurality of electrical contacts extends through a respective through-hole of the back plate and such that the magnetically activated switch is adjacent to the back plate. The data cable connector also comprises a data cable part embodied to connect with a data cable, the data cable part including: a second PCB including a second plurality of electrical contacts disposed on a first side of the second PCB; a second housing having an end face having a second plurality of through-holes; and a magnet disposed inside the second housing on an inside surface of the end face, wherein the second PCB is disposed within the second housing such that each of the second plurality of electrical contacts extends through a respective through-hole of the end face, wherein the second housing is shaped and sized complementary to the second recess such that the second housing is enabled to be inserted into the second recess, wherein when the second housing is fully inserted into the second recess, each of the first plurality of electrical contacts makes galvanic contact with a respective electrical contact of the second plurality of electrical contacts, and wherein when the second housing is fully inserted into the second recess, the magnet activates the magnetically activated switch.

The magnetically activated switch may be a reed switch or may be a circuit including a Hall effect sensor.

The first end of the first housing may include a threaded connection embodied to attach the first housing to a cable gland of a field device housing. The second recess of the first housing may include a projection disposed on an inside wall of the second recess, and the second housing may include a third recess along an outside wall of the second housing, wherein when the second housing is inserted into the second recess of the first housing, the projection in the second recess engages with the third recess on the second housing.

The first plurality of electrical contacts may be sockets, and the second plurality of electrical contacts may be pins. When the second housing is fully inserted into the second recess, each pin may protrude into a respective socket.

According to another embodiment of the disclosure, disclosed also is a data cable connector, comprising a field device part embodied to connect with a process automation field device, the field device part including a first printed circuit board (PCB) having a first plurality of electrical contacts disposed on a first side of the first PCB and extending from the first PCB; a first magnetically activated switch and a second magnetically activated switch each disposed on the first side of the first PCB; a plurality of wires electrically connected with the first plurality of electrical contacts and connected with the two magnetically activated switches, wherein the plurality of wires extend from a second side of the first PCB; and a first housing having a first recess disposed at a first end of the housing, a second recess disposed at a second end of the housing, and a contact support body disposed interior to the second recess, wherein the contact support body separates the second recess from the first recess and divides the second recess into a first half-moon shaped sub-recess and a second half-moon shaped sub-recess symmetrical to the first half-moon-shaped sub-recess, and wherein the first end of the first housing is embodied to mechanically attach to a field device such that the attaching to the field device closes and seals the first recess, wherein the contact support body includes a first plurality of through-holes, wherein the first PCB is disposed inside the first recess such that each of the first plurality of electrical contacts extends through a respective through-hole of the contact support body and such that the first magnetically activated switch is adjacent to the first half-moon shaped sub-recess and the second magnetically activated switch is adjacent to the second half-moon shaped sub-recess.

The data cable connector may further comprise a data cable part embodied to connect with a data cable, the data cable part including a second housing having an end face and a half-moon shaped protrusion extending from the end face, wherein the end face includes a plurality of through-holes; a second plurality of electrical contacts disposed within the second housing, wherein each of the second plurality of electrical contacts extends through a respective hole in the end face; and a magnet disposed inside the protrusion, wherein the protrusion is shaped and sized complementary to the first and second half-moon shaped recesses such that the protrusion is enabled to be inserted into the first half-moon shaped sub-recess or the second half-moon shaped sub-recess, wherein when the protrusion is fully inserted into the first half-moon shaped sub-recess, each of the first plurality of electrical contacts makes galvanic contact with a respective electrical contact of the second plurality of electrical contacts, the magnet activates the first magnetically activated switch, and the second magnetically activated switch remains inactivated, wherein when the protrusion is fully inserted into the second half-moon shaped sub-recess, each of the first plurality of electrical contacts makes galvanic contact with a respective electrical contact of the second plurality of electrical contacts, the magnet activates the second magnetically activated switch, and the first magnetically activated switch remains inactivated, and wherein when the protrusion is not inserted into either half-moon shaped recess, the first magnetically activated switch remains inactivated and the second magnetically activated switch remains inactivated.

The magnetically activated switches may be magnetic reed switches or may include a circuit including Hall effect sensors.

The first end of the first housing may include a threaded connection embodied to attach the first housing to a cable gland of a field device housing.

According to another embodiment of the present disclosure, disclosed is a process automation field device comprising a microcontroller including a memory; a first digital communication circuit, wherein the first digital communication circuit is connected with the microcontroller for the communication of digital data between the microcontroller and the first digital communication circuit; a second digital communication circuit, wherein the second digital communication circuit is connected with the microcontroller for the communication of digital data between the microcontroller and the second digital communication circuit; a multiplexer, wherein the first and second digital communication circuits are further connected with the multiplexer.

The field device may further comprise a field device part of a data cable connector, the field device part including a printed circuit board (PCB) having a plurality of electrical contacts disposed on a first side of the PCB and extending from the PCB; a housing having a first end embodied to connect with the field device and having a second end having a recess, wherein the PCB is disposed in the housing such that the plurality of electrical contacts extend into the recess, and wherein the recess has a first sub-recess and a second sub-recess; a first magnetically activated switch disposed in the housing adjacent to the first sub-recess and a second magnetically activated switch disposed in the housing adjacent to the second sub-recess; and a plurality of wires electrically connecting the plurality of electrical contacts to the multiplexer and connecting the two magnetically activated switches to field device, wherein the first sub-recess and the second sub-recess enable a connection of a complementary data cable part of a data cable connection to the field device part in two mutually exclusive orientations, wherein the two magnetically activated switches are so disposed that only one magnetically activated switch is activated when the data cable part is connected to the field device part, wherein the microcontroller is configured to detect the activation of the first magnetically activated switch and the activation of the second magnetically activated switch; detect the deactivation of the first magnetically activated switch and the deactivation of the second magnetically activated switch; enable the first communication circuit and configure the multiplexer such that the first communication circuit is connected with the plurality of electrical contacts when the first magnetically activated switch is activated; configure the multiplexer such that the first communication circuit is disconnected from the plurality of electrical contacts when the first magnetically activated switch is not activated; enable the second communication circuit and configure the multiplexer such that the second communication circuit is connected with the plurality of electrical contacts when the second magnetically activated switch is activated; and configure the multiplexer such that the second communication circuit is disconnected from the plurality of electrical contacts when the second magnetically activated switch is not activated.

The magnetically activated switches may be magnetic reed switches or may be circuits including Hall effect sensors.

According to another embodiment of the present disclosure, disclosed is a process automation field device, comprising a microcontroller including a memory; a first digital communication circuit, wherein the first digital communication circuit is connected with the microcontroller for the communication of digital data between the microcontroller and the first digital communication circuit; a second digital communication circuit, wherein the second digital communication circuit is connected with the microcontroller for the communication of digital data between the microcontroller and the second digital communication circuit; a multiplexer, wherein the first and second digital communication circuits are further connected with the multiplexer.

The field device may further comprise a field device part of a data cable connector, the field device part including a printed circuit board (PCB) including a plurality of electrical contacts disposed on a first side of the PCB and extending from the PCB and further including a first logic contact and a second logic contact, each logic contact disposed on the first side of the PCB and extending from the PCB; a housing having a first end embodied to connect with the field device and having a second end having a recess, wherein the PCB is disposed in the housing such that the plurality of electrical contacts and the two logic contacts extend into the recess, and wherein the recess has a first sub-recess and a second sub-recess; and a plurality of wires electrically connecting the plurality of electrical contacts to the multiplexer and connecting the two logic contacts to logic circuits of the field device, wherein the first sub-recess and the second sub-recess enable a connection to the field device of a complementary data cable part of a data cable connection in two mutually exclusive orientations.

The field device's microcontroller may be configured to detect a logic level at the first logic contact and a logic level at the second logic contact; enable the first communication circuit, disable the second communication circuit, and configure the multiplexer such that the first communication circuit is connected with the plurality of electrical contacts when the first logic contact is at a first logic level and the second logic contact is at a second logic level not equal to the first logic level; enable the second communication circuit, disable the first communication circuit, and configure the multiplexer such that the second communication circuit is connected with the plurality of electrical contacts when the first logic contact is at the second logic level and the second logic contact is at the first logic level; and disable the first communication circuit, disable the second communication circuit, and configure the multiplexer such that the first communication circuit and the second communication circuit are disconnected from the plurality of electrical contacts when the first logic contact and the second logic contact are at the same logic level.

DETAILED DESCRIPTION

The present disclosure discloses a data cable connector for use in connecting a field service tool to a process automation field device. The present disclosure also discloses a process automation field device having such a data cable connector. Various embodiments of the disclosed devices will now be presented in conjunction with the figures that illustrate the embodiments. It will be understood that no limitation of the scope of this disclosure is thereby intended.

Figure 1:
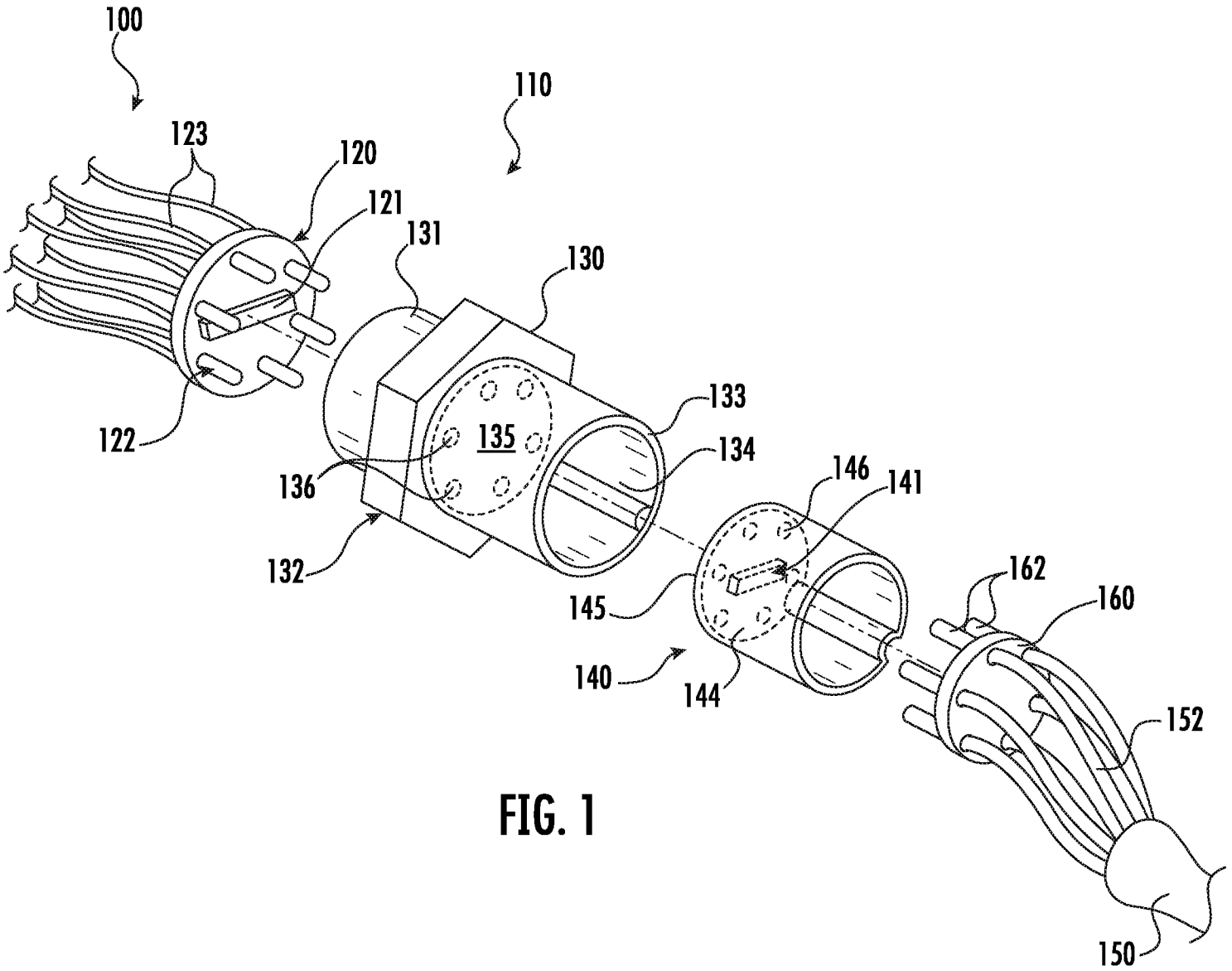
FIG. 1 shows a data cable connector according to an embodiment of the present disclosure.

FIG. 1 shows a data cable connector 100 according to an embodiment of the present disclosure. The data cable connector 100 may include a field device part 110 that includes a housing 130. The housing 130 may have a first end 131 having a threaded connector 132 embodied to connect with a field device housing (not shown in FIG. 1). The threaded connector 132 may be further embodied to connect with a cable gland of the field device housing (not shown in FIG. 1). The housing 130 may have a second end 133 having a recess 134 and a back plate 135. The recess 134 may be cylindrical as shown, although other geometries for the recess 134 are also acceptable. The back plate 135 has a plurality of through holes 136 that extend completely through the back plate 135. Notwithstanding the plurality of through holes 136 in the back plate 135, the back plate 135 closes the distal end of the recess 134.

The field device part 110 may further include a printed circuit board (PCB) 120 having a magnetically activated switch 121 and a plurality of electrical contacts 122. The PCB 120 may be disposed within the housing 130 such that the plurality of electrical contacts 122 protrude through the through holes 136 and into the recess 134. Each of the electrical contacts 122 may have a respective through hole 136 through which the electrical contact 122 extends.

When the PCB 120 is disposed in the housing 130, the magnetically activated switch 121 may be disposed behind and adjacent to the back plate 135, that is, on a side of the back plate 135 opposite a side of the back plate 135 that is within the recess 134. Because the magnetically activated switch 121 is disposed behind the back plate 135, the material of which back plate 135 is embodied is a non-ferrous material.

The data cable connector 100 may further include a data cable end 140 embodied to connect with an end of a data cable 150 having a plurality of wires 152. The data cable end 140 may include a PCB 160 having a plurality of electrical contacts 162. Each electrical contact 162 may be connected with a wire 152 of the data cable 150. The particular application of the data cable connector 100 will specify the particular connections between the wires 152 and the electrical contacts 162.

The data cable end 140 may include a housing 144 embodied to couple with the recess 134 of the housing 130. The housing 144 may be embodied in a shape complementary to the recess 134 of the housing 130. For example, if the geometry of the recess 134 is cylindrical, the geometry of the housing 144 may be likewise cylindrical so that housing 144 fits within the recess 134.

The housing 144 may have an end face 145 having a plurality of through holes 146. A magnet 141 may be disposed on a side of the end face 145 interior to the housing 144.

The PCB 160 along with the contacts 162 may be disposed in the housing 144 such that the electrical contacts 162 extend into the through holes 146 of the end face 145. The electrical contacts 162 need not extend beyond the through holes 146; it is sufficient if the electrical contacts 162 extend into the through holes 146 and are flush with an outer surface of the end face 145.

The housing 144 is embodied to be removably inserted into the recess 134. As noted above, the geometry of the housing 144 is complementary to the geometry of the recess 134 so that the housing 144 and the recess 134 may fit together. When the housing 144 is inserted into the recess 134, the end face 145 of the housing 144 may make contact with the back plate 135 in the recess 134. Also, when the housing 144 is inserted into the recess 134, the electrical contacts 162 may make galvanic contact with the electrical contacts 122.

In FIG. 1, the electrical contacts 122 are shown as pins, and the electrical contacts 162 are shown as sockets. In this embodiment, when the housing 144 is inserted into the recess 134, each pin 122 may extend into a respective socket 162 such that a galvanic contact is made between each pin 122 and each socket 162. However, other embodiments of both the electrical contacts 122 and the electrical contacts 162 are possible so long as the two sets of electrical contacts make galvanic contact with each other when the housing 144 is inserted into the recess 134.

The PCB 120 may be contacted by a plurality of wires 123. At least two wires of the plurality of wires 123 may connect the magnetically activated switch 121 with the communication circuit of the field device (not shown in FIG. 1). The remaining wires of the plurality of wires 123 may connect the electrical contacts 122 with the communication circuit of the field device.

When the housing 144 of the data cable end 140 is inserted fully within the recess 134 of the field device part, the field device part 110 and the data cable end 140 are considered connected. In the connected state, each electrical contact 162 galvanically contacts a corresponding and respective electrical contact 122. Additionally, in the connected state of the data cable connector 100 in which the housing 144 is fully inserted into the recess 134, the magnet 141 is disposed near the magnetically activated switch 121 such that the magnet 141 activates the magnetically activated switch 121. In this context, activate means to change the state of the magnetically activated switch 121. If the magnetically activated switch 121 is normally closed, activate means that the magnet 141 causes the magnetically activated switch 121 to open. Alternately, if the magnetically activated switch 121 is normally open, activate means that the magnet 141 causes the magnetically activated switch 121 to close.

The magnetically activated switch 121 may be implemented as a magnetic reed switch. Alternately, the magnetically activated switch 121 may be implemented as a circuit including a Hall effect sensor. Other implementations of the magnetically activated switch 121 are also possible.

Figure 2A:
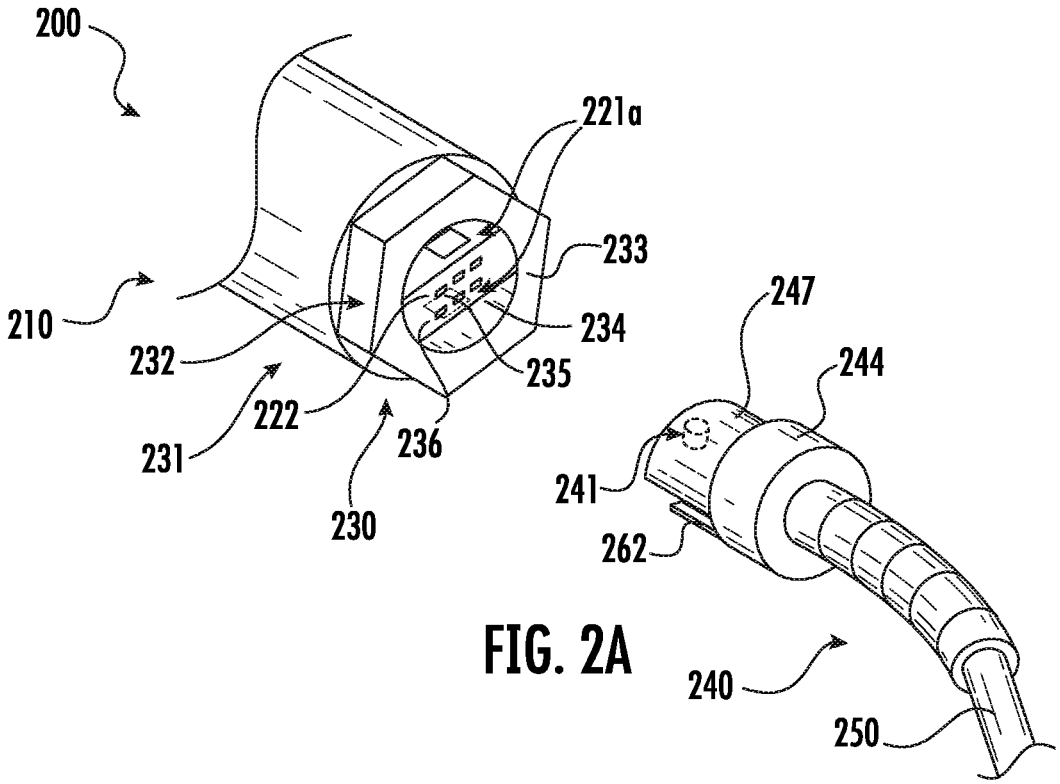
FIG. 2A shows a data cable connector according to an embodiment of the present disclosure.

FIG. 2A shows a data cable connector 200 according to an embodiment of the present disclosure. The data cable connector 200 as shown in FIG. 2A may be embodied in a manner very similar to the data cable connector 100 as shown in FIG. 1 and may have many of the same features. The data cable connector 200 may include a field device part 210. The field device part 210 may include a first end 231 having a threaded connection 232 embodied to connect to a field device. The field device part 210 may have a second end 233 having a recess 234 in which a contact support body 235 having through holes 236 is disposed.

As shown in FIG. 2A, the recess 234 may be divided into two (or more) symmetric recesses of a specific geometry by the contact support body 235. As shown in FIG. 2A, the recess 234 is divided into two half-moon shaped recesses 234*a* and 234*b*. Such half-moon shaped recesses allow the connection of a complementary connector (e.g., a connector having a half-moon shaped body) in one of two distinct, mutually exclusive orientations.

The field device part 210 may include a PCB 220 (not shown in FIG. 2A) on which a plurality of electrical contacts 222 are disposed. Each of the plurality of electrical contacts 222 may be disposed behind a respective through hole 236 of the contact support body 235. In the embodiment as shown in FIG. 2A, the electrical contacts 222 are embodied as sockets, though other embodiments of the electrical contacts 222 are also possible and within the scope of the present disclosure.

The field device part 210 may further include two magnetically activated switches 221*a*, 221*b*. The magnetically activated switches 221*a*, 221*b* may be mounted in the field device part such that a first magnetically activated switch 221*a* is mounted within the half-moon shaped recess 234*a* and a second magnetically activated switch 221*b* is mounted within the half-moon shaped recess 234*b*. The magnetically activated switches 221*a*, 221*b* may be magnetic reed switches or may be circuits including one or more Hall effect sensors.

As with the field device part 110 of the data cable connector 100, the field device part 210 may include a plurality of wires (not shown in FIG. 2) connecting the plurality of electrical contacts 222 and also the two magnetically activated switches 221*a*, 221*b* to the electronic circuits of the field device.

The data cable connector 200 may further include a data cable end 240 embodied to connect with an end of a data cable 250 having a plurality of wires (not shown in FIG. 2A). The data cable end 240 may include a plurality of electrical contacts 262. Each electrical contact 262 may be connected with a respective wire of the data cable 250. The particular application of the data cable connector 200 will specify the particular connections between the wires of the data cable and the electrical contacts 262.

The data cable end 240 may include a housing 244 embodied to couple with the recess 234 of the housing 230. As shown in FIG. 2A, the housing 244 may have a half-moon shaped protrusion 247 complementary to the half-moon shape of the recess 234*a* or 234*b*. The protrusion 247 is shaped and sized to fit within either recess 234*a* or 234*b*. The protrusion 247 may include a magnet 241 disposed on a lateral face of the protrusion 247.

When the protrusion 247 is fully inserted into either recess 234*a*, 234*b*, the field device part 210 and the data cable end 240 are considered connected. In the connected state of the data cable connector 200, each electrical contact 262 may galvanically contact a corresponding and respective electrical contact 222.

If the connection between the field device part 210 and the data cable end 240 is made in a first orientation by the insertion of the protrusion 247 into the recess 234*a* (such orientation is shown in FIG. 2A), the magnet 241 may activate the first magnetically activated switch 221*a* disposed in the recess 234*a*. However, in this first orientation of the connection of the field device part 210 and the data cable end 240, the magnet 241 will not activate the second magnetically activated switch 221*b* disposed in the recess 234*b*.

Figure 2B:
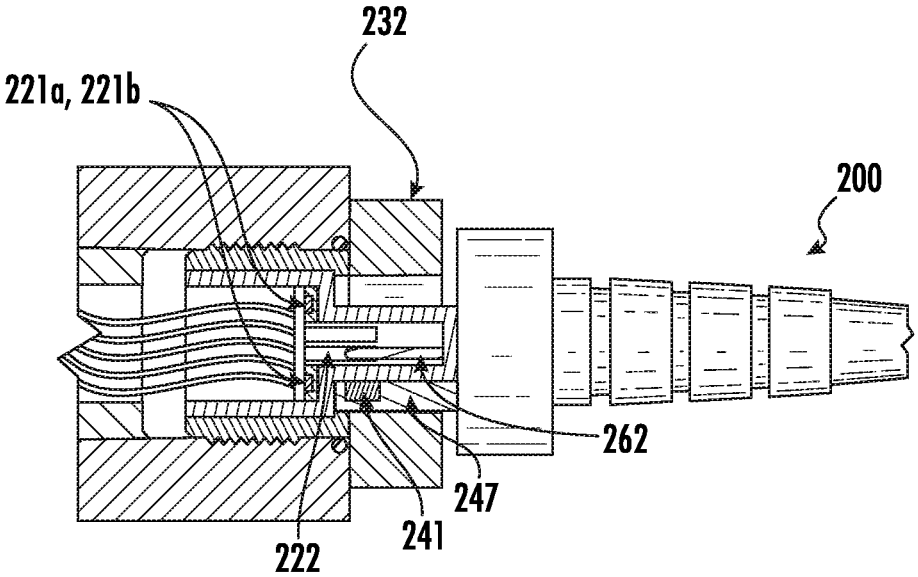
FIG. 2B shows the data cable connector of FIG. 2B connected in a second orientation.

If instead the connection between the field device part 210 and the data cable end 240 is made in a second orientation by the insertion of the protrusion 247 into the recess 234*b* (such orientation is shown in FIG. 2B), the magnet 241 may activate the second magnetically activated switch 221*b* disposed in the recess 234*b*. However, in this second orientation of the connection of the field device part 210 and the data cable end 240, the magnet 241 will not activate the first magnetically activated switch 221*a* disposed in the recess 234*a*.

Such an activating of the magnetically activated switches 221*a*, 221*b* in which no magnetically activated switch is activated absent a connection of a data cable end 240, in which only a first magnetically activated switch 221*a* is activated when the data cable end 240 is connected in a first orientation, and in which only a second magnetically activated switch 221*b* is activated when the data cable end 240 is connected in a second orientation, allows a field device to activate or de-activate communication circuits and configure electrical contacts 222 based on the presence and orientation of the data cable connector 240. Such a field device may, for example, communicate using a first communication protocol when the data cable end is connected in the first orientation and may communicate using a second communication protocol when the data cable end is connected in the second orientation.

Figure 3:
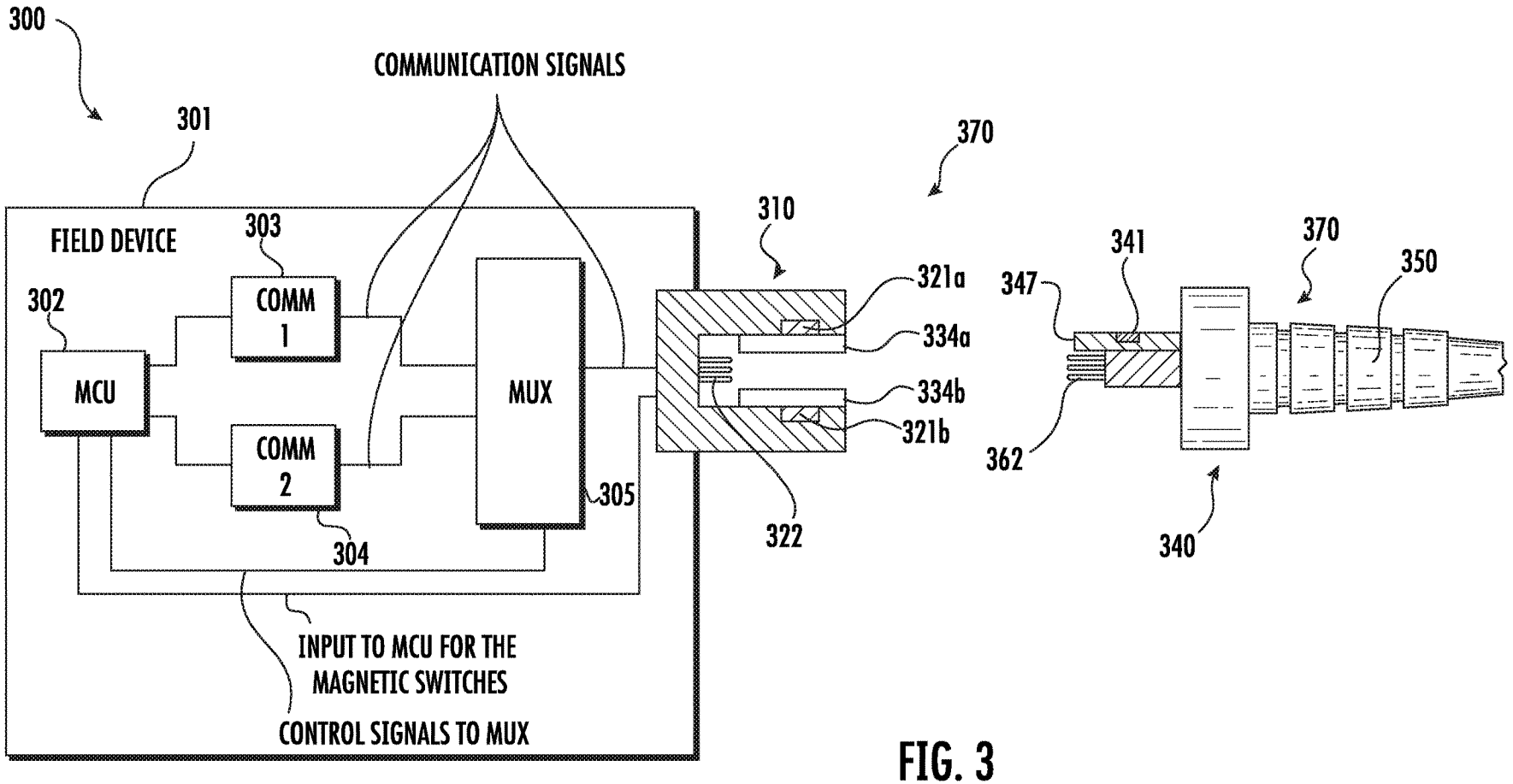
FIG. 3. schematically shows a field device according to an embodiment of the present disclosure.

FIG. 3. schematically shows a field device 300 according to an embodiment of the present disclosure. The field device 300 may comprise a central controller 302, a first communication circuit 303, a second communication circuit 304, and a multiplexer 305. The field device may further include other components (not shown in FIG. 3) such as a transducer for measuring some physical phenomenon and electronic circuitry for processing a measuring signal produced by the transducer. Or, alternately, the field device may include motor controls or switches for controlling a valve, a motor, etc., of an automated process. The field device 300 may include a housing 301 enclosing and protecting the various internal components of the field device 300.

The field device 300 according to the present disclosure may further include a field device part 310 of a data cable connection. Such a field device part 310 is shown schematically in FIG. 3. The field device 310 part may be embodied to connect with a complementary data cable part 340 of a data cable connection. The field device part 310 may include a first recess 334*a*, a second recess 334*b*, and a plurality of electrical contacts 322. The first recess 334*a* may include a first magnetically activated switch 321*a*, and the second recess 334*b* may also include a second magnetically activated switch 321*b*. The magnetically activated switches 321*a*, 321*b* may be magnetic reed switches or may be circuits including one or more Hall effect sensors.

The first magnetically activated switch 321*a* and the second magnetically activated switch 321*b* may be configured to be normally open or normally closed. If a magnetically activated switch is by default normally open (i.e., an open circuit), then activating the switch closes the switch. If, however, the magnetically activated switch is by default normally closed (i.e., a short circuit), then activating the switch opens the switch.

The first communication circuit 303 and the second communication circuit 304 may each be connected with the electrical contacts 322 of the field device part 310, but this electrical connection may be through the multiplexer 305. The connecting of the electrical contacts 322 to the communication circuits through a multiplexer 305 allows the multiplexer 305 to configure the input/output status of the various electrical contacts 322 and allows the multiplexer 305 to allocate the various electrical contacts 322 to either the first communication circuit 303 or the second communication circuit 304.

The central controller 302 may be connected to the multiplexer 305 for the configuration and control of the multiplexer 305.

The central controller 302 may be connected to the first communication circuit 303 for the communication of data between the central controller 302 and the first communication circuit 303 and also for control and configuration of the first communication circuit 303 by the central controller 302. The central controller 302 may be likewise connected to the second communication circuit 304.

When the data cable part 340 of the data cable connector 370 is inserted into the field device part 310 of the data cable connector 370 in a first orientation such that the protrusion 347 is inserted into the first recess 334*a*, the magnet 341 in the protrusion 347 may activate the first magnetically activated switch 321*a*. However, when the data cable part 340 is inserted into the field device part 310 in the first orientation, the second magnetically activated switch 321*b* in the second recess 334*b* is not activated.

When the data cable part 340 is connected with the field device part 310 in a first orientation and the first magnetically activated switch 321*a* is activated by the magnet 341 of the protrusion 347, the microcontroller 302 may read the activated state of the first magnetically activated switch 321*a* and may configure the first communication circuit 303, the second communication circuit 304, and the multiplexer 305 accordingly. For example, the microcontroller 302 may activate the first communication circuit 303 including any modem and PHY circuits within the first communication circuit 303. The microcontroller 302 may also deactivate the second communication circuit 304 including any modem and PHY circuits within the second communication circuit 304. In addition, the microcontroller 302 may configure the multiplexer 305 so that communication signals from the first communication circuit 303 are connected with the electrical contacts 322 and so that communication signals from the second communication circuit 304 are not connected with the electrical contacts 322.

Alternately, if the data cable part 340 is connected with the field device part 310 in a second orientation and the second magnetically activated switch 321*b* is activated by the magnet 341 of the protrusion 347, the microcontroller 302 may read the activated state of the second magnetically activated switch 321*b* and may configure the second communication circuit 304, the first communication circuit 303, and the multiplexer 305 accordingly. For example, the microcontroller 302 may activate the second communication circuit 304 including any modem and PHY circuits within the second communication circuit 304. The microcontroller 302 may also deactivate the first communication circuit 303 including any modem and PHY circuits within the first communication circuit 303. In addition, the microcontroller 302 may configure the multiplexer 305 so that communication signals from the second communication circuit 304 are connected with the electrical contacts 322 and so that communication signals from the first communication circuit 303 are not connected with the electrical contacts 322.

In an embodiment of the field device according to the present disclosure, if the microcontroller 302 does not detect either an activation of the first magnetically activated switch 321*a* or an activation of the second magnetically activated switch 321*b*, the microcontroller may disable both the first communication circuit 303 and the second communication circuit 304 and may configure the multiplexer so that the electrical contacts 322 have no electrical connection to any circuits within the field device 300.

In an embodiment of the field device according to the present disclosure, if the microcontroller 302 detects the deactivation of a magnetically activated switch 321*a*, 321*b* that was previously activated, the microcontroller 302 may disable the respective communication circuit 303, 304 that was enabled. In addition, the microcontroller 302 may configure the multiplexer so that the electrical contacts 322 have no electrical connection to any circuits within the field device 300.

By thus enabling a communication circuit only when the presence of a data cable connection is detected, and by thus disabling the communication circuits in the absence of a data cable connection, the field device 300 may reduce its electrical power consumption by not energizing communication circuits needlessly.

Figure 4:
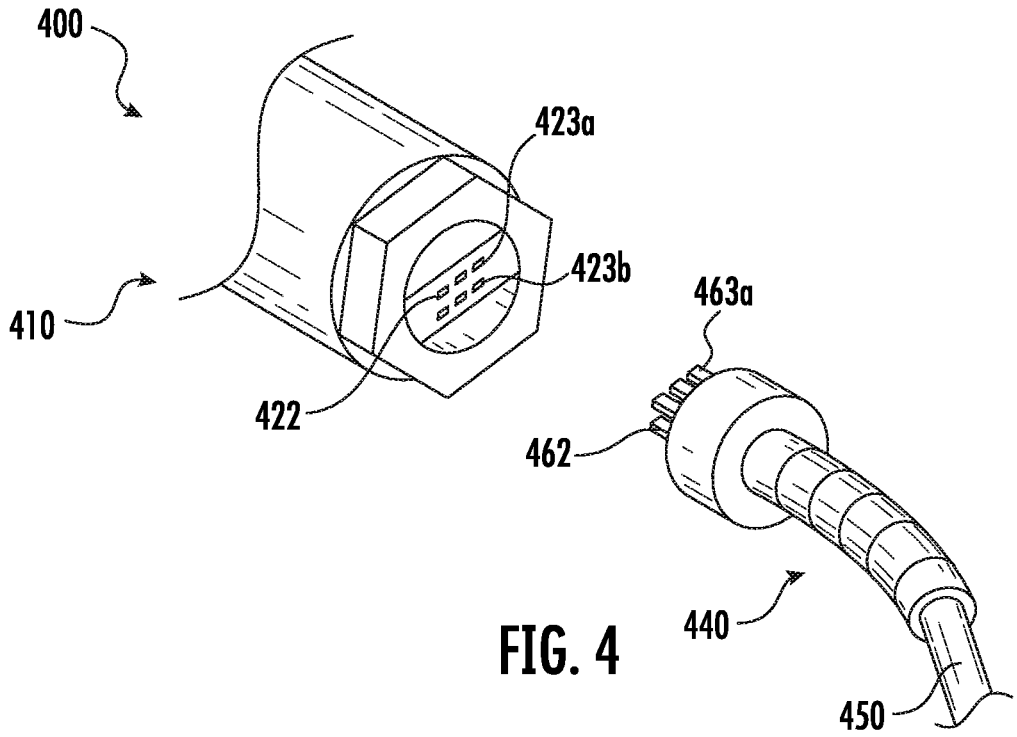
FIG. 4 shows a data cable connector according to an embodiment of the present disclosure.

FIG. 4 shows a data cable connector 400 according to an embodiment of the present disclosure. The data cable connector 400 as shown in FIG. 4 may be embodied in a manner similar to the data cable connector 200 as shown in FIG. 2A and may have many of the same features. The data cable connector 400 may include a field device part 410 and may further include a data cable end 440. The field device part 410 may include a plurality of electrical contacts 422 that may be electrically connected with electronic circuits of a field device. The data cable end 440 may include a plurality of electrical contacts 462 that are electrically connected with the wires of the data cable 450 and embodied to electrically connect with the plurality of electrical contacts 422 of the field device part 410. The field device part 410 and the data cable end 440 may be embodied to releasably connect with each other such that each of the plurality of electrical contacts 422 galvanically contacts a corresponding electrical contact 462.

In addition to the plurality of electrical contacts 422, the field device part 410 may further include a first logic contact 423*a* and a second logic contact 423*b*. Each of the logic contacts 423*a*, 423*b* may be an electrical contact that may be connected with the electronic circuits of the field device so that the field device may determine a logic level present at the logic contact 423*a*, 423*b*.

The data cable end 440 may likewise include a first logic contact 463*a* and a second logic contact 463*b* (not shown in the perspective view of FIG. 4). When the field device part 410 and the data cable end 440 are releasably connected together, the logic contacts 423*a*, 423*b* of the field device part 440 may galvanically contact the logic contacts 463*a*, 463*b* of the data cable end 440. Though the number of logic contacts is not limited to two, for clarity of explanation and illustration, only two such contacts are described and shown.

A field device having such a field device part 410 having logic contacts 423*a*, 423*b* may monitor the logic level of the logic contacts 423*a*, 423*b*. If the field device detects that the first logic contact 423*a* is being pulled high and that the second logic contact 423*b* is being pulled low, for example, the field device may configure the plurality of electrical contacts 422 to communicate using a first communication protocol. The field device may additionally enable and configure communication circuits within the field device to use the first communication protocol. Or, alternately, if the field device detects that the first logic contact 423*a* is being pulled low and that the second logic contact 423*b* is being pulled high, the field device may configure the plurality of electrical contacts 422 to communicate using a second communication protocol. The field device may additionally enable and configure communication circuits within the field device to use the second communication protocol. Or, alternately, if the field device detects that both logic contacts 423*a*, 423*b* are being pulled high or are being pulled low (i.e., both logic contacts 423*a*, 423*b* are at the same logic level), then the field device may disable both the first and the second communication protocol and may configure the electrical contacts 422 to be in a high impedance state.

The driving of the logic contacts 423*a*, 423*b* of the field device part 410 may be effected via the logic contacts 463*a*, 463*b* of the data cable end 440. For example, a service tool (such as a hand-held computer) may use a data cable having a data cable end 440 to connect with a field device having a field device part 410. The service tool may drive the logic contacts 463*a*, 463*b* of the data cable end 440 to specify the particular communication protocol the service tool will be using for communication with the field device. For example, the service tool may drive the first logic contact 463*a* (and thus the first logic contact 423*a*) high and the second logic contact 463*b* (and thus the second logic contact 423*b*) low to specify that the field device should use a first communication protocol for communication with the service tool.

Figure 5A:
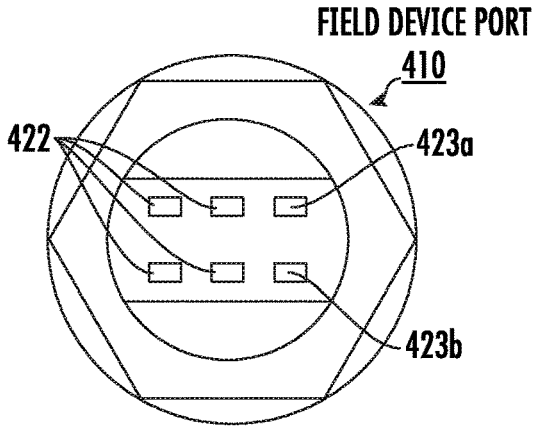
FIGS. 5A and 5B show a first way in which the logic pins of the field device part and the data cable end may be disposed, according to an embodiment of the present disclosure.
Figure 5B:
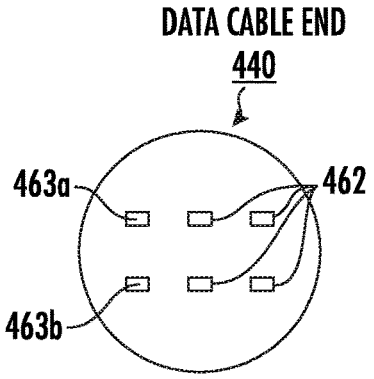

FIGS. 5A and 5B show a first way in which the logic pins of the field device part 410 and the data cable end 440 may be disposed. In the exemplary embodiment as shown in FIG. 5A, there are four electrical contacts 422, a first logic contact 423*a*, and a second logic contact 423*b* on the field device part 410. In the data cable end 440 as shown in FIG. 5B, there are likewise four electrical contacts 462, a first logic contacts 463*a*, and a second logic contact 463*b*. Each connector part 410, 440 is shown from its end view, and when the connector parts 410, 440 are connected together, the electrical contacts 462 galvanically contact electrical contacts 422, the first logic contact 463*a* galvanically contacts the first logic contact 423*a*, and the second logic contact 463*b* galvanically contacts the second logic contact 423*b*.

Such an embodiment of the data cable connector as shown in FIG. 5 may be used by a service tool in the servicing of a field device, for example. After the connecting of the data cable end 440 of a data cable to the field device part 410 of a field device, the service tool may hold the logic level of the first logic contact 463*a* high and the logic level of the second logic contact 463*b* low to indicate to the field device that a first communication protocol is to be used. Or, alternately, the service tool may hold the logic level of the first logic contact 463*a* low and the logic level of the second logic contact 463*b* high to indicate to the field device that a second communication protocol is to be used. Such a setting—or even a switching—of communication protocols may be made on the service tool, for example, by the toggling of a switch or the selecting of a menu item in a user interface.

If, however, the data cable end 440 is not connected with the field device part 410, then the logic contacts 423*a*, 423*b* may be left floating, or the logic level on the logic contacts 423*a*, 423*b* may be set by pull-up or pull-down resistors within field device. The field device may be configured to detect that the logic level on the first logic contact 423*a* is the same as that on the second logic contact 423*b*, and the field device may disable or keep disabled the communication circuits within the field device that are configured to communicate via the field device part 410.

Figure 6A:
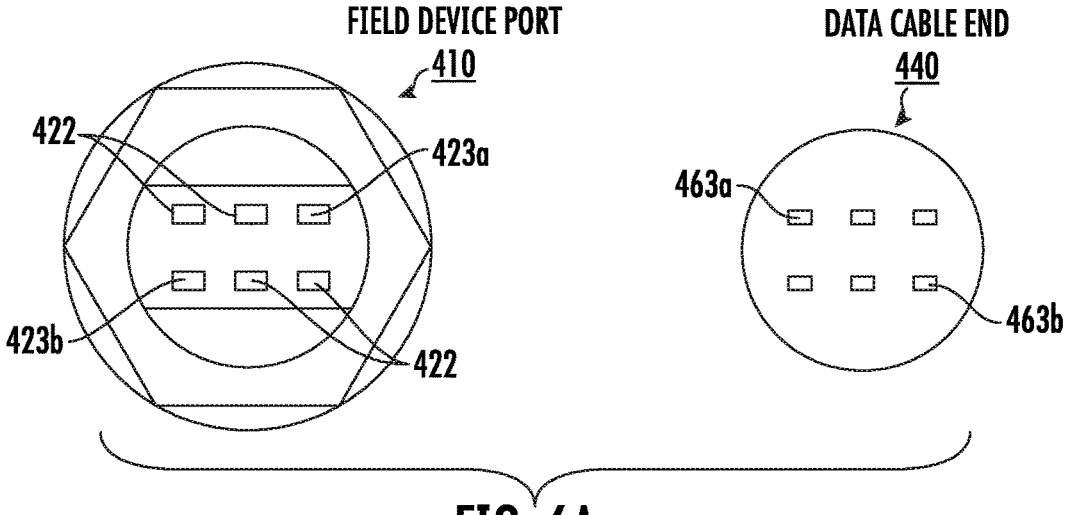
FIGS. 6A and 6B show a second way in which the logic contacts of the field device part and the data cable end may be disposed, according to an embodiment of the present disclosure.
Figure 6B:
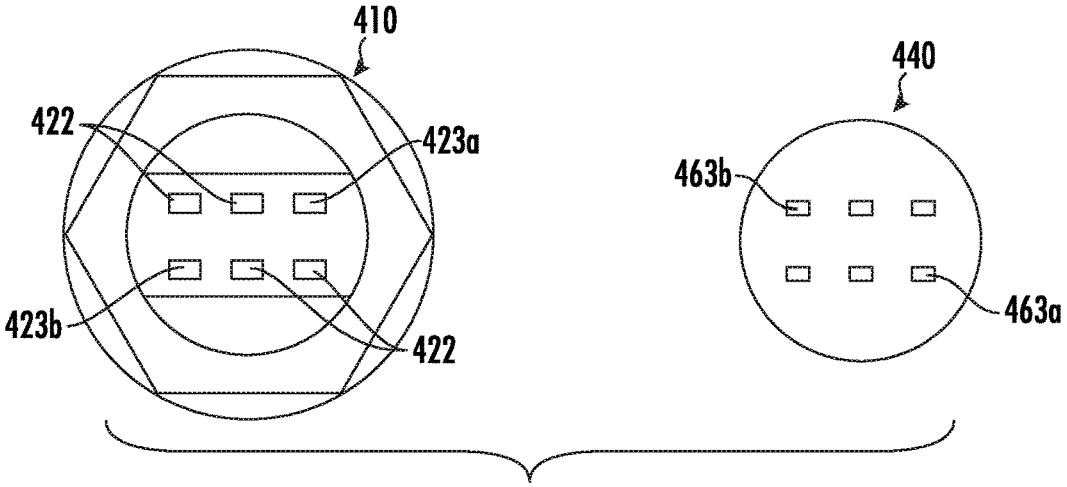

FIGS. 6A and 6B show a second way in which the logic contacts of the field device part 410 and the data cable end 400 may be disposed. In the embodiment as shown in FIG. 6A, the logic contacts on both the field device part 410 and the data cable end 440 may be disposed in opposite corners of the arrangement of electrical contacts. For example, in FIG. 6A, the first logic contact 423*a* is disposed in the upper right of the array of electrical contacts while the second logic contact 423*b* is disposed in the lower left of the array of electrical contacts of the field device part 410. FIG. 6A shows also the logic contacts 463*a*, 463*b* of the data cable end 440 disposed in opposite corners of the array of electrical contacts. As is shown in FIG. 5, the field device part 410 and the data cable end 440 are viewed from their respective ends in both FIGS. 6A and 6B.

FIG. 6B shows the same field device part 410 and the same data cable end 440 as shown in FIG. 6A. However, the data cable end 440 has been rotated by 180° in FIG. 6B from that shown in FIG. 6A.

When the field device part 410 and the data cable end 440 as shown in FIG. 6A are connected together, the first logic contact 463*a* of the data cable end 440 contacts the first logic contact 423*a* of the field device part 410, and the second logic contact 463*b* contacts the second logic contact 423*b*. However, if the data cable end 440 is first rotated 180° as shown in FIG. 6B, then when the field device part 410 is connected with the data cable end 440, the first logic contact

463*a* of the data cable end 440 contacts the second logic contact 423*b* of the field device part 410, and the second logic contact 463*b* contacts the first logic contact 423*a*.

In such an arrangement of logic contacts as shown in FIGS. 6A and 6B, the service tool (or other such device) connected via the data cable to data cable end 440 may hold the logic contact 463*a* at a logic high level and the logic contact 463*b* at a low logic level. When the data cable end 440 is connected with the field device part 410 in the orientation as shown in FIG. 6A, the logic high level at logic contact 423*a* and the logic low level at logic contact 423*b* may indicate to the field device that a first communication protocol is to be used. However, by simply rotating the data cable end 440 by 180° from the first orientation as shown in FIG. 6A to the second orientation as shown in FIG. 6B, the logic high level now at logic contact 423*b* and the logic low level now at logic contact 423*a* may indicate to the field device that a second communication protocol is to be used. Therefore, in this embodiment as shown in FIGS. 6A and 6B, the communication protocol which the service tool uses to communicate with the field device may be changed automatically simply by removing the data cable end 440 from the field device part 410 and then reconnecting the two with the data cable end 440 rotated by 180°.

While various embodiments of a data cable connector have been described in considerable detail herein, the embodiments are merely offered by way of non-limiting examples of the disclosure described herein. It will therefore be understood that various changes and modifications may be made, and equivalents may be substituted for elements and steps thereof, without departing from the scope of the disclosure. Indeed, this disclosure is not intended to be exhaustive or to limit the scope of the disclosure.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Such sequences may be varied and still remain within the scope of the present disclosure. Therefore, the particular order of the steps disclosed herein should not be construed as limitations of the present disclosure.

What is claimed:

1. A data cable connector, comprising:

a field device part embodied to connect with a process automation field device, the field device part including:

a first printed circuit board (PCB) including a magnetically activated switch disposed on a first side of the first PCB and a first plurality of electrical contacts disposed on the first side of the first PCB and extending from the first PCB;

a plurality of wires electrically connected with the magnetically activated switch and with the first plurality of electrical contacts, wherein the plurality of wires extend from a second side of the first PCB; and a first housing having a first recess disposed at a first end of the first housing, a second recess disposed at a second end of the first housing, and a back plate disposed interior to the second recess, wherein the back plate separates the second recess from the first recess, wherein the first end of the first housing is embodied to mechanically attach to a cable gland of the process automation field device such that the attaching to the cable gland closes and seals the first recess, wherein the back plate includes a first plurality of through-holes, wherein the first PCB is disposed inside the first recess such that each of the first plurality of electrical contacts extends through a respective through-hole of the back plate and such that the magnetically activated switch is adjacent to the back plate; and a data cable part embodied to connect with a data cable, the data cable part including:

a second PCB including a second plurality of electrical contacts disposed on a first side of the second PCB;

a second housing having an end face having a second plurality of through-holes; and a magnet disposed inside the second housing on an inside surface of the end face, wherein the second PCB is disposed within the second housing such that each of the second plurality of electrical contacts extends through a respective through-hole of the end face, wherein the second housing is shaped and sized complementary to the second recess such that the second housing is enabled to be inserted into the second recess, wherein when the second housing is fully inserted into the second recess, each of the first plurality of electrical contacts makes galvanic contact with a respective electrical contact of the second plurality of electrical contacts, and wherein when the second housing is fully inserted into the second recess, the magnet activates the magnetically activated switch.

2. The data cable connector of claim 1, wherein the magnetically activated switch is a magnetic reed switch.

3. The data cable connector of claim 1, wherein the magnetically activated switch includes a Hall effect sensor.

4. The data cable connector of claim 1, wherein the first end of the first housing includes a threaded connection embodied to attach the first housing to the cable gland of the process automation field device.

5. The data cable connector of claim 1, wherein the second recess includes a projection disposed on an inside wall of the second recess and the second housing includes a third recess along an outside wall of the second housing, wherein when the second housing is inserted into the second recess, the projection in the second recess engages with the third recess on the second housing.

6. The data cable connector of claim 1, wherein the first plurality of electrical contacts are sockets and the second plurality of electrical contacts are pins, and wherein when the second housing is fully inserted into the second recess, each pin protrudes into a respective socket.

7. A data cable connector, comprising:

a field device part embodied to connect with a process automation field device, the field device part including:

a first printed circuit board (PCB) having a first plurality of electrical contacts disposed on a first side of the first PCB and extending from the first PCB;

a first magnetically activated switch and a second magnetically activated switch each disposed on the first side of the first PCB;

a plurality of wires electrically connected with the first plurality of electrical contacts and connected with the two magnetically activated switches, wherein the plurality of wires extend from a second side of the first PCB; and a first housing having a first recess disposed at a first end of the first housing, a second recess disposed at a second end of the first housing, and a contact support body disposed interior to the second recess, wherein the contact support body separates the second recess from the first recess and divides the second recess into a first half-moon shaped sub-recess and a second half-moon shaped sub-recess symmetrical to the first half-moon-shaped sub-recess, and wherein the first end of the first housing is embodied to mechanically attach to a cable gland of the process automation field device such that the attaching to the cable gland closes and seals the first recess, wherein the contact support body includes a first plurality of through-holes, wherein the first PCB is disposed inside the first recess such that each of the first plurality of electrical contacts extends through a respective through-hole of the contact support body and such that the first magnetically activated switch is adjacent to the first half-moon shaped sub-recess and the second magnetically activated switch is adjacent to the second half-moon shaped sub-recess; and a data cable part embodied to connect with a data cable, the data cable part including:

a second housing having an end face and a half-moon shaped protrusion extending from the end face, wherein the end face includes a plurality of through-holes;

a second plurality of electrical contacts disposed within the second housing, wherein each of the second plurality of electrical contacts extends through a respective hole in the end face; and a magnet disposed inside the protrusion, wherein the protrusion is shaped and sized complementary to the first and second half-moon shaped recesses such that the protrusion is enabled to be inserted into the first half-moon shaped sub-recess or the second half-moon shaped sub-recess, wherein when the protrusion is fully inserted into the first half-moon shaped sub-recess, each of the first plurality of electrical contacts makes galvanic contact with a respective electrical contact of the second plurality of electrical contacts, the magnet activates the first magnetically activated switch, and the second magnetically activated switch remains inactivated, wherein when the protrusion is fully inserted into the second half-moon shaped sub-recess, each of the first plurality of electrical contacts makes galvanic contact with a respective electrical contact of the second plurality of electrical contacts, the magnet activates the second magnetically activated switch, and the first magnetically activated switch remains inactivated, and wherein when the protrusion is not inserted into either half-moon shaped recess, the first magnetically activated switch remains inactivated and the second magnetically activated switch remains inactivated.

8. The data cable connector of claim 7, wherein the magnetically activated switches are magnetic reed switches.

9. The data cable connector of claim 7, wherein the magnetically activated switches include Hall effect sensors.

10. The data cable connector of claim 7, wherein the first end of the first housing includes a threaded connection embodied to attach the first housing to the cable gland of the process automation field device.

11. A process automation field device, comprising:

a microcontroller including a memory;

a first digital communication circuit, wherein the first digital communication circuit is connected with the microcontroller for the communication of digital data between the microcontroller and the first digital communication circuit;

a second digital communication circuit, wherein the second digital communication circuit is connected with the microcontroller for the communication of digital data between the microcontroller and the second digital communication circuit; a multiplexer, wherein the first and second digital communication circuits are further connected with the multiplexer;

a field device part of a data cable connector, the field device part including:

a printed circuit board (PCB) having a plurality of electrical contacts disposed on a first side of the PCB and extending from the PCB;

a housing having a first end embodied to connect with a cable gland of the process automation field device and having a second end having a recess, wherein the PCB is disposed in the housing such that the plurality of electrical contacts extend into the recess, and wherein the recess has a first sub-recess and a second sub-recess;

a first magnetically activated switch disposed in the housing adjacent to the first sub-recess and a second magnetically activated switch disposed in the housing adjacent to the second sub-recess; and a plurality of wires electrically connecting the plurality of electrical contacts to the multiplexer and connecting the two magnetically activated switches to the process automation field device, wherein the first sub-recess and the second sub-recess enable a connection of a complementary data cable part of a data cable connection to the field device part in two mutually exclusive orientations, wherein the two magnetically activated switches are so disposed that only one magnetically activated switch is activated when the data cable part is connected to the field device part, wherein the microcontroller is configured to:

detect the activation of the first magnetically activated switch and the activation of the second magnetically activated switch;

detect the deactivation of the first magnetically activated switch and the deactivation of the second magnetically activated switch;

enable the first communication circuit and configure the multiplexer such that the first communication circuit is connected with the plurality of electrical contacts when the first magnetically activated switch is activated;

configure the multiplexer such that the first communication circuit is disconnected from the plurality of electrical contacts when the first magnetically activated switch is not activated;

enable the second communication circuit and configure the multiplexer such that the second communication circuit is connected with the plurality of electrical contacts when the second magnetically activated switch is activated; and configure the multiplexer such that the second communication circuit is disconnected from the plurality of electrical contacts when the second magnetically activated switch is not activated.

12. The field device of claim 11, wherein the magnetically activated switches are magnetic reed switches.

13. The field device of claim 11, wherein the magnetically activated switches include Hall effect sensors.

14. A process automation field device, comprising:

a microcontroller including a memory;

a first digital communication circuit, wherein the first digital communication circuit is connected with the microcontroller for the communication of digital data between the microcontroller and the first digital communication circuit;

a second digital communication circuit, wherein the second digital communication circuit is connected with the microcontroller for the communication of digital data between the microcontroller and the second digital communication circuit;

a multiplexer, wherein the first and second digital communication circuits are further connected with the multiplexer;

a field device part of a data cable connector, the field device part including:

a printed circuit board (PCB) including a plurality of electrical contacts disposed on a first side of the PCB and extending from the PCB and further including a first logic contact and a second logic contact, each logic contact disposed on the first side of the PCB and extending from the PCB;

a housing having a first end embodied to connect with a cable gland of the process automation field device and having a second end having a recess, wherein the PCB is disposed in the housing such that the plurality of electrical contacts and the two logic contacts extend into the recess, and wherein the recess has a first sub-recess and a second sub-recess; and a plurality of wires electrically connecting the plurality of electrical contacts to the multiplexer and connecting the two logic contacts to logic circuits of the process automation field device, wherein the first sub-recess and the second sub-recess enable a connection to the field device of a complementary data cable part of a data cable connection in two mutually exclusive orientations, wherein the microcontroller is configured to:

detect a logic level at the first logic contact and a logic level at the second logic contact;

enable the first communication circuit, disable the second communication circuit, and configure the multiplexer such that the first communication circuit is connected with the plurality of electrical contacts when the first logic contact is at a first logic level and the second logic contact is at a second logic level not equal to the first logic level;

enable the second communication circuit, disable the first communication circuit, and configure the multiplexer such that the second communication circuit is connected with the plurality of electrical contacts when the first logic contact is at the second logic level and the second logic contact is at the first logic level; and disable the first communication circuit, disable the second communication circuit, and configure the multiplexer such that the first communication circuit and the second communication circuit are disconnected from the plurality of electrical contacts when the first logic contact and the second logic contact are at the same logic level.

* * * * *